US007048261B2

(12) United States Patent
Wright

(10) Patent No.: US 7,048,261 B2
(45) Date of Patent: May 23, 2006

(54) LIQUIDS DUMPING DEVICE

(76) Inventor: Alan Dale Wright, 20 Thirteenth Road, Kew, 2090 Johannesburg (ZA)

( * ) Notice: Subject to any disclaimer, the term of this patent is extended or adjusted under 35 U.S.C. 154(b) by 0 days.

(21) Appl. No.: 10/311,694

(22) PCT Filed: Jun. 20, 2001

(86) PCT No.: PCT/ZA01/00085

§ 371 (c)(1),
(2), (4) Date: Aug. 11, 2003

(87) PCT Pub. No.: WO01/98695

PCT Pub. Date: Dec. 27, 2001

(65) Prior Publication Data

US 2004/0012101 A1 Jan. 22, 2004

(51) Int. Cl.
*B01F 3/04* (2006.01)

(52) U.S. Cl. ..... 261/37; 261/72.1; 261/97; 261/DIG. 46

(58) Field of Classification Search ..... 261/36.1, 261/37, 66, 68, 70, 72.1, 97, DIG. 46
See application file for complete search history.

(56) References Cited

U.S. PATENT DOCUMENTS

| | | | | |
|---|---|---|---|---|
| 2,646,061 | A * | 7/1953 | Bottum | 137/142 |
| 3,411,449 | A | 11/1968 | Murdoch | |
| 3,773,307 | A * | 11/1973 | Karlsson | 261/97 |
| 3,794,306 | A | 2/1974 | Engalitcheff, Jr. | |
| 3,862,280 | A | 1/1975 | Polovina | |
| 4,361,522 | A * | 11/1982 | Goettl | 261/66 |
| 4,510,766 | A * | 4/1985 | Curtis, Sr. | 62/171 |
| 5,106,543 | A * | 4/1992 | Dodds | 261/36.1 |
| 5,292,103 | A * | 3/1994 | West et al. | 251/30.05 |

* cited by examiner

*Primary Examiner*—Scott Bushey
(74) *Attorney, Agent, or Firm*—Heller Ehrman LLP

(57) ABSTRACT

A process and apparatus for periodically dumping liquids in an installation, in which liquids are recycled or otherwise accumulate dissolved and/or suspended contaminants, which process and apparatus makes use of a container for a liquid which is alternately filled and drained during operation of the installation, resulting in changing weight or buoyancy of the container or level of a float in the container, which actuates a dumping valve when a given critical weight, buoyancy or float level is exceeded or reduced.

2 Claims, 5 Drawing Sheets

LIQUIDS DUMPING DEVICE

FIELD OF THE INVENTION

Figure 1:
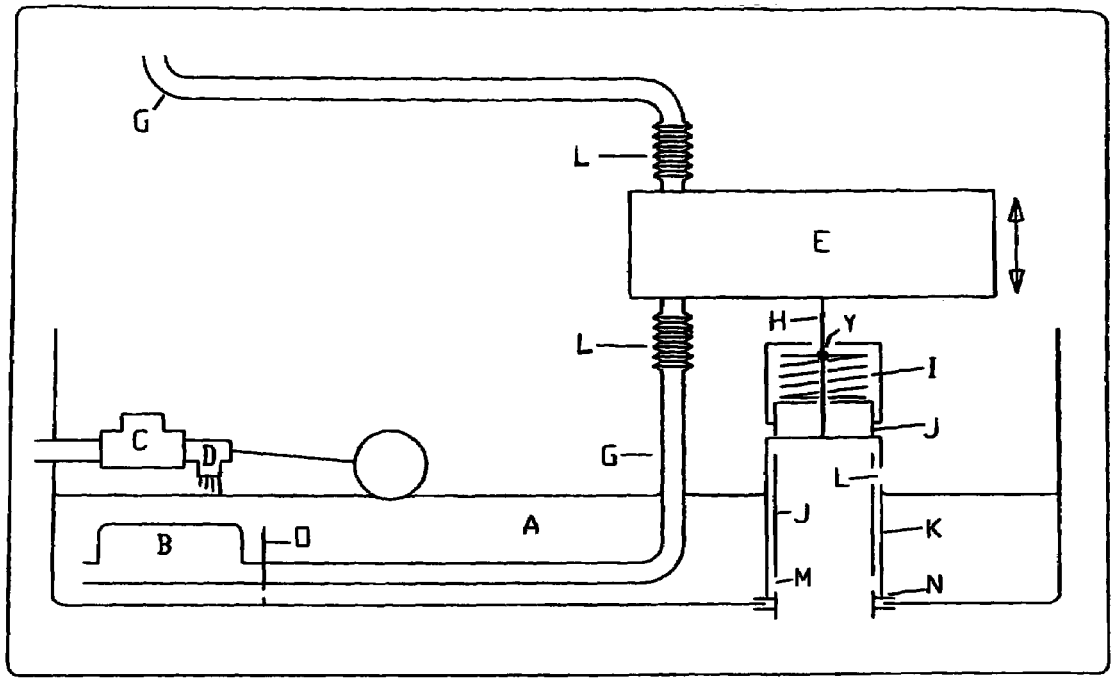

This application is the national phase under 35 U.S.C. § 371 of PCT International Application No. PCT/ZA01/00085 which has an International filing date of Jun. 20, 2001, which claims priority from South Africa Application No. ZA 2000/3108 filed Jun. 21, 2000, which is hereby incorporated by reference.

This invention lies in the field of apparatuses and processes which use liquids in circumstances where the liquids are re-circulated or continuously kept in circulation or in other circumstances where concentrations of dissolved and suspended solids or other contaminants in the liquids tend to increase over a period of time.

A particular application of the invention, for example, is in the field of evaporative cooling systems, dust extractors, systems which condition air and similar applications. The accumulation of suspended and dissolved solids in liquids—in particular in the case of evaporative cooling applications, water—can occur from more than one source. Examples are carbonates and bicarbonates of various minerals which are present in some water supplies and accumulations of substances which arise from the process conditions in which the liquid, in particular water is used. For example the gradual rise in dissolved solids and other solids in suspension, etc., can occur in sumps, return tanks and the like. Bacterial growth can also be a problem where water stands when not operating.

THE PRIOR ART

If the concentration of these substances in, for example, water is not kept low enough there is a tendency for settling and sedimentation, scaling and other deposits which can accumulate over time. These can have a damaging effect on apparatus and equipment. An example is in matrixes, webs, heat exchanger tubes and channels of devices that condition air with use of water, e.g. cooling, dust extraction and the like where substantial damage and/or reduction of efficiency and general physical deterioration can take place from such materials.

A convenient manner of dealing with this problem is to periodically dump such liquids, particularly water which is an inexpensive approach.

Particularly, for example, in the application to evaporative cooling installations timing devices have been utilised to actuate solenoid valves, dumping valves, float control valves and other mechanisms. Devices known to the applicant and in use up to now have, however, experienced reliability problems. Often these are due to the very issues which are being contemplated and require dealing with, namely the settling and accretion of dissolved and other solids as concentrations of these arise which tend to cause blockages, sticking and unreliable operation in other ways. For example, where electrical contactors, electrical breakers and similar features are present the conditions where they have to operate often cause a susceptibility to arcing as a result of condensation, carbon build up and similar processes. Is sues of electrical safety also provided their own source of difficulties in these contexts. For example, in a system known to applicant, the actuator in the original drain valve was a wax filled cylinder which was heated electrically, to be actuated. Condensation on the actuator cylinder, heat wafers and corresponding connection points usually occurred during the night and short circuiting or arcing resulted.

The inventor perceived that it would be advantageous to eliminate electricity from the system, if possible given the need for periodic dumping.

THE INVENTION

The present invention provides a process and apparatus for periodically dumping liquids in an installation, in which liquids are recycled or otherwise accumulate dissolved and/or suspended contaminants, which process and apparatus makes use of a container for a liquid which is alternately filled and drained during operation of the installation, resulting in changing weight or buoyancy of the container or level of a float in the container, which actuates a dumping valve when a given critical weight, buoyancy or float level is exceeded or reduced.

The process will thus have the feature of a cycle which is punctuated by the liquid being periodically dumped, resulting in prevention of gradual concentration or accumulation of contaminants.

The process may have the basis that the container normally remains filled and dumping occurs when it drains, or it may normally remain empty and dumping occurs when it fills. The periodicity of the cycle may be determined by other events in the installation where these are cyclical. An example of what is meant here, is an air conditioning application which operates for a part only of each 24 hour period, here the dumping could occur each time the conditioning stops.

The ongoing filling of the container may be provided for by a supply of the liquid, for example, water and that supply may be by some convenient means, either from a source under pressure, from a source of water under a head above the level of the container, from an output of the pump or the like.

In accordance with the invention it is convenient if the source of the liquid is linked to the normal operation of the installation. For example, where the installation makes use of a pump, arrangement can be made to bleed off from the pump's supply a liquid, for example, water which will gradually fill the container and have the result described. Alternatively, water supplied to the evaporative cooler can be made to pass through the container. When the container is full, water overflows from the container into the sump of the evaporative cooler installation. A small bleed off from the pump's supply may be used to close a drain situated in the container to prevent it from draining during times when the water supply to the evaporative cooler is off.

An arrangement must be made for the container to be drained so as to cause the dumping action to occur and so that it will be re-set to commence a filling cycle again over a period of time. For example, when output water from the pump in the installation is utilised to fill the container the filling or maintaining the container full will continue while the pump operates. When output water pressure from the pump is used to close the drain situated in the container the container will remain full while the pump operates. If the installation is shut down so that the pump is switched off then the filling or drain prevention process of the container is terminated and the drain will open and the container will be allowed to drain so as to be ready when the pump returns to operation, at which time the container will be filled or kept from draining having been filled until the point is reached when the dump valve closes.

THE DRAWINGS

The invention will now be described by way of the following non-limiting examples with reference to the accompanying drawings.

FIG. 1 is a schematic illustration of apparatus for periodically dumping liquids in accordance with an embodiment of the invention, forming part of an air-conditioning installation which provides cooling of air by evaporative cooling effects, FIGS. 2–6 are similar illustrations of alternative embodiments of apparatus for periodically dumping liquids in accordance with the invention, and FIGS. 7 to 10 are illustrations of the preferred embodiment of the invention.

THE EMBODIMENTS OF THE INVENTION

Evaporative cooling units generally draw air through webs or mats of material, for example, a material sold under the trade mark "Celdek" is well known and effective. Another effective material is generally known as "Aspen Fibre" or "Wood wool".

Referring now to FIG. 1, water enters sump A of an evaporative air cooler via a water supply solenoid C when C is activated and level control device D is open. The inlet water discharges into a partitioned area of the sump A, the partition being formed by closure plate O. Water pump B is situated within the partitioned area and drain valve J is situated exterior the partitioned area. Pump B is a centrifugal type pump through which water is free to flow in the reverse direction when it is not running. Closure plate O is provided with an opening located at its lower region to allow water to drain from the partitioned area into the remainder of the sump A.

The partitioned area, created by plate O, effectively dams sufficient water to enable pump B to pump water into tank E prior to the sump A becoming full. When the pump B is switched off and the sump A has drained or is in the process of draining, the hole located in the lower region of the closure plate O allows the partitioned area to drain.

Water entering the partitioned area via the level control device D fills the partitioned area and then flows over the top of pump closure plate O into the remainder of sump A. Water draining into the remainder of sump A through the drain hole located at the lower region of the closure plate O does not drain from the partitioned area as quickly as water is introduced into the system via the water supply solenoid C and level control device D.

Whilst the pump B is in an inoperative condition, water will drain out of sump A via drain valve J. When the pump B is switched on and thereby brought into an operative condition, water is pumped into water container E, which is filled with air.

When water container E which is supported by connecting rod H reaches a certain gross weight, it descends having overcome the net upward force of spring I. Since connecting rod H is further connected to an outer valve sleeve K of the drain valve J and to lifting spring I at connection point Y, K in turn descends and seals against seal N at the bottom of the valve J which subsequently prevents water from draining from the water sump A. The spring I, outer valve sleeve K, drain valve J and seal N form the dumping valve.

Container E is sized and dimensioned to hold sufficient water so that the weight of the container E when full provides sufficient downward force to close the drain valve J and prevent any water from draining out of the sump A.

As pump B continues to run, air and then excess water is expelled from the top of container E via pipe G. This water rises to the top of the evaporative cooler, where it is distributed over 'cooling pads'. This water then trickles down the pads (not shown) and reenters sump A.

Whilst the pump B is running and the water supply solenoid C is open, the water level in sump A is maintained via the level control device D. When it is desired to drain sump A, the water supply solenoid C is closed and pump B is switched off. Water then drains out of pipe G, container E and pump B in a reverse direction due to gravity. As the water drains from container E it is replaced by air entering via a riser section of pipe G, and container E therefore becomes lighter.

When sufficient water has drained from the container E, a point will be reached when the upward force exerted by spring I is greater than the downward forces acting upon it, and as a result container E begins to rise. As container E rises the outer valve sleeve K rises, opening the valve J at the seal N. This enables water to drain from sump A via the drainage holes M and the sump A remains empty until the water supply solenoid C is again opened.

Lifting spring I is designed to exert sufficient upward force so as to overcome the downward force generated by water container E when empty, the resistance to movement of flexible couplings L and the weight of all moving components of valve J. In addition it imparts sufficient upward force in order to ensure that valve J opens. The magnitude of this force is designed to overcome any possibility of the valve jamming in the closed position and to also ensure that the valve opens at an acceptable rate when container E is drained.

Flexible couplings L are provided to allow for up and downward movement of container E as it fills with water and empties.

Figure 2:
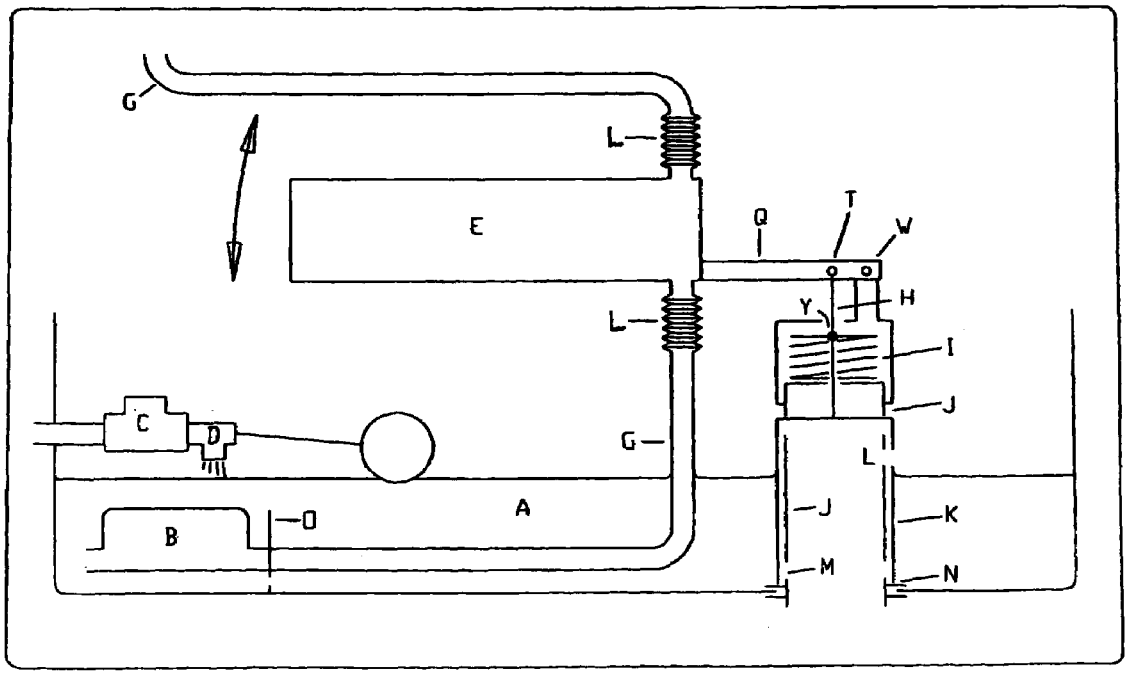

Referring now to FIG. 2, the basic operation of the apparatus shown is similar to that described for FIG. 1.

The difference between FIGS. 1 and 2 is that in the embodiment shown in FIG. 2, a leverage device is incorporated into the system which enables container E to be reduced in size, making it less bulky. The container E is supported by actuator arm Q which is connected to the connecting rod H at point T.

The assembly rotates about fulcrum W of actuating arm Q which enables the upward and downward movement of container E.

Figure 3:
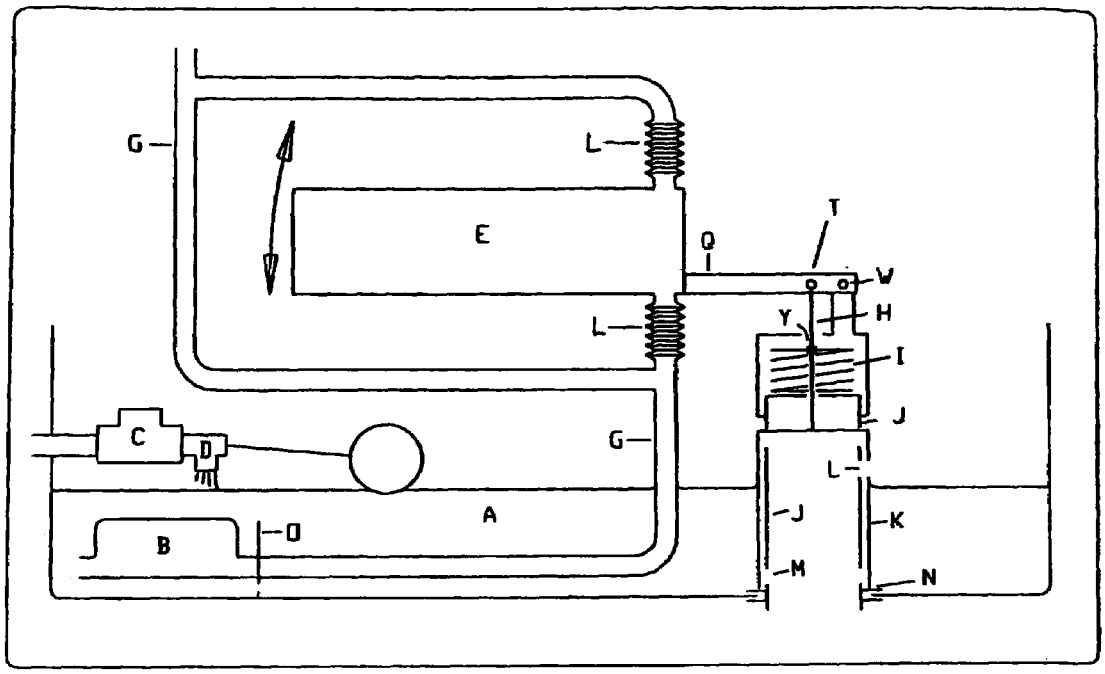

Referring now to FIG. 3, the apparatus shown operates as per FIGS. 1 and 2 except that not all the water pumped by pump B is forced to pass through container E as it is delivered to the 'cooling pads' mentioned above. Water is able to by-pass container E which allows smaller diameter pipes to be connected to container E at the water connection points.

The operation of the apparatus shown in FIG. 3 is again analogous to that described for FIG. 1.

Figure 4:
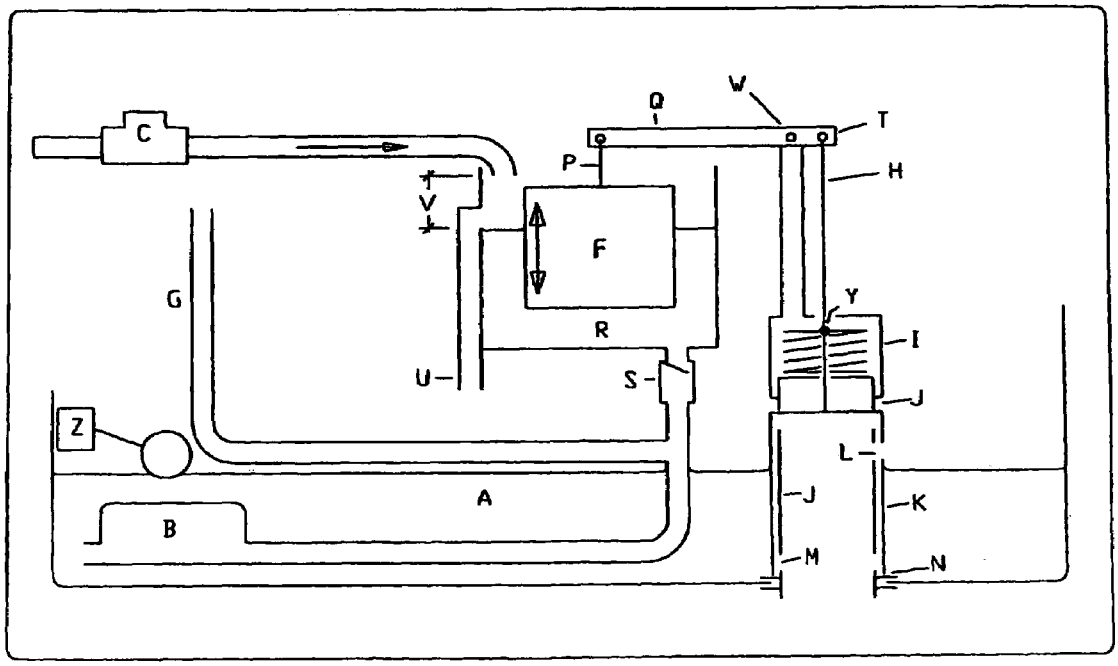

FIG. 4 lacks the closure plate O shown in FIGS. 1 to 3. When sump A is required to be filled with water, the level control device Z (or other suitable level control device) will cause the water supply solenoid C to open and allow water to flow into water tank R. As tank R begins to fill, the valve actuating float F begins to rise as it displaces water in tank R.

As the water rises in tank R and float F begins to displace more water than its own empty weight, a progressively increasing upward force is transmitted to arm Q. Actuator arm Q is connected to the connecting rod H at point T. The upward force of spring I is thereby overcome and a downward force is exerted to the outer valve sleeve K of the valve J via the actuator arm Q and the connecting rod H. The force on the seal N is such that no leakage from the sump A occurs. The buoyant force of float F should be such that the total displaced weight of water causes sufficient upward force to close the drain valve and prevent any water draining from sump A.

Tank R continues to fill and eventually water will overflow through the overflow discharge pipe U into the sump A which in turn will cause the sump A to fill with water.

Prior to switching on the pump B and thereby bringing it into an operative condition, water from tank R will begin to drain into the water sump A via the one way valve S and pump B. As mentioned in the description of FIG. 1, pump B is a centrifugal type pump through which water is free to flow in the reverse direction when it is not running.

The tank R remains full as the rate of flow of water out of the tank is less than the inflow through its fill pipe. Water entering the main sump A from the overflow pipe U continues to fill the sump until sump A is full at which point the level control device Z causes the water supply solenoid C to close.

A signal from the level control device Z may be used to start pump B. The pump B should be started at or soon after the time when the level control device Z causes the water supply solenoid C to close.

As soon as the pump B is in the operative condition, water is pumped into pipe G which supplies water to the cooling pads of the evaporative cooler.

The pressure in pipe G causes water to begin to flow into tank R which causes one way valve S to close thereby preventing a further flow of water into or out of tank R via the one way valve S. This is necessary as tank R would otherwise begin to empty when the level control device Z switches off the supply water into the evaporative cooler when sump A becomes full.

Whilst the evaporative cooler is operating, water evaporates into the air stream passing through the cooling pads thus causing the level control device Z to intermittently open the water supply solenoid C to maintain the full level in sump A.

If tank R is allowed to empty when water supply solenoid C is switched off, the valve float F will drop, causing the drain valve J to open and allow the water to drain from sump A.

The outlet drain in tank R is required since if it were not fitted, once full, tank R would remain full and it would not be possible to drain sump A when switching off the evaporative cooler.

When it is desired to drain sump A the inlet solenoid C is closed and the pump B is switched off. Water then drains from pipe G and tank R, via pump B due to gravity. Water is able to drain from tank R as the one way valve S opens when pressure on it is removed due to water pump B no longer pumping water.

As the water drains from tank R the upward force acting on rod P is reduced as less water is displaced by the valve actuating float F. When sufficient water has drained from the tank R, a point will be reached when the upward force of spring I overcomes the downward forces acting upon it and the valve actuating float F will begin to drop.

The upward force exerted by lifting spring I must be sufficiently large to overcome any downward force acting upon it thereby ensuring that valve J opens as sleeve K rises when tank R is drained. An additional upward force is required and should be incorporated into spring I to avoid the possibility of the valve jamming in the closed position and to ensure that the valve opens at an acceptable rate when water tank R is drained.

As float F drops, the outer valve sleeve K rises thereby opening the valve at the seal N. Water from sump A is thereby allowed to drain from the sump A which remains empty until the inlet solenoid C is again switched on.

The discharge point of the water supply pipe to tank R is above the overflow level of the tank R. This is designed to prevent water from being siphoned back into the main water supply system should it fail at any time. Height V should be sufficient to ensure that the system complies with regulations that may apply to sump filling systems in the countries or areas of installation.

Figure 5:
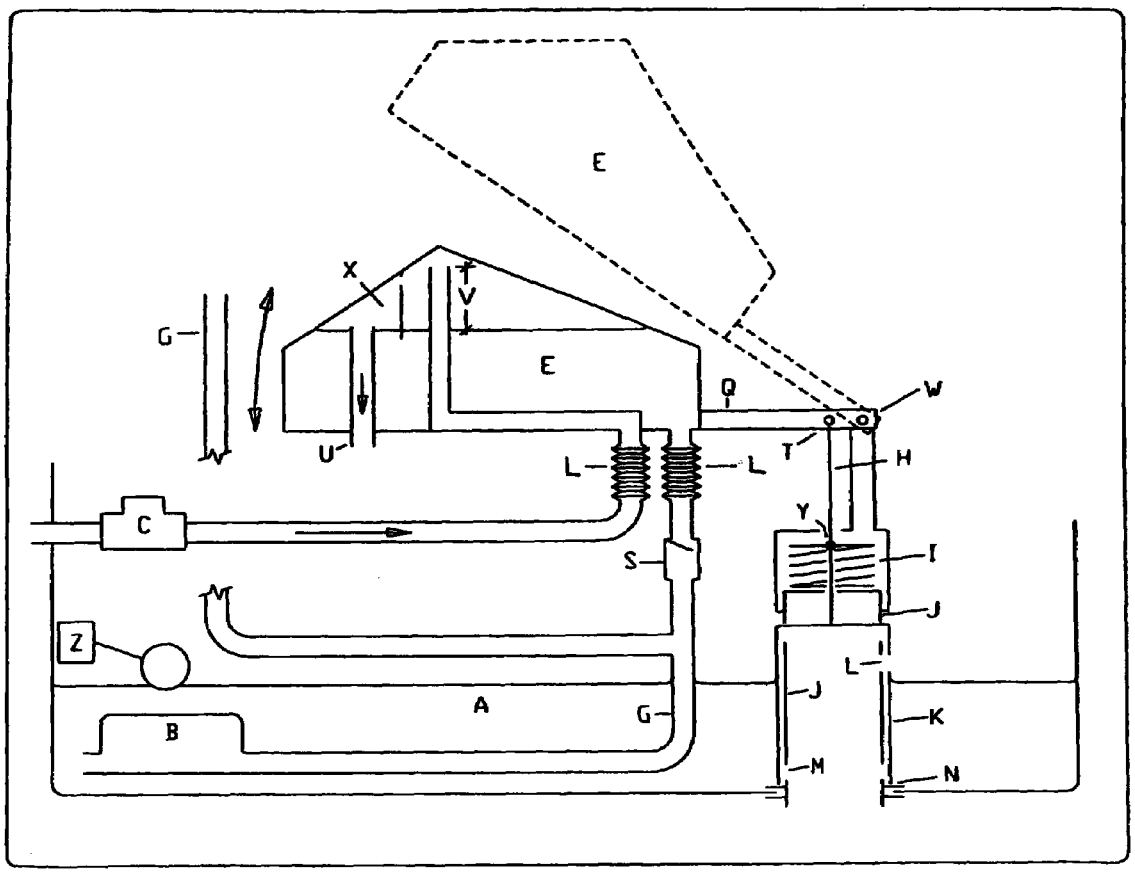

FIG. 5 lacks the closure plate O shown in FIGS. 1 to 3. When sump A is required to be filled with water, the level control device Z will cause the water supply solenoid C to open and allow water to flow into water container E via the water supply fill pipe and flexible coupling L.

As water flows into container E air in the tank is displaced and expelled via the discharge into sump pipe U. Separator X prevents water flowing into water container E from splashing directly into the discharge into sump pipe U. The separator X is fitted with a small hole at its upper region to allow free movement of air from one side of the separator to the other. A bottom edge of separator X extends below the top of discharge into sump pipe U.

As container E fills with water its total weight increases and it rotates about the fulcrum W as it descends due to the increasing weight of water in the tank. The arc of travel should be limited so that the centre of gravity of the container E cannot fall to the right hand side of the fulcrum W when valve J is in the open position. A rotational angle of 45 degrees or less would be regarded as appropriate.

As the water rises in container E the downward force on connecting rod H increases thereby overcoming the upward force of spring I. Actuator arm Q is connected to the connecting rod H at point T. Connection rod H moves the outer valve sleeve K of the valve J downwards and onto drain seal N thereby preventing water from draining out of sump A. As water continues to flow into container E it overflows via the discharge U into sump A which begins to fill. Container E should be sized and dimensioned to hold sufficient water so that the weight of the container E when full provides sufficient downward force to close the drain valve and prevent any water from draining from the sump A.

Prior to switching on pump B water from container E will have been draining into the water sump A via the one way valve S and centrifugal type pump B. Container E remains full and overflowing as the rate of flow of water out of the drain hole in the bottom of the tank is less than the inflow through the water supply pipe. When sump A is full, the level control device Z causes the water supply solenoid C to close.

A signal from the level control device Z may be used to start pump B. The pump should be started at or soon after the time when the level control device causes the water supply solenoid C to close as a result of the water sump A having become full. As soon as pump B is switched on water flows from the pump into pipe G which supplies water to the cooling pads of the evaporative cooler.

The pressure in pipe G causes water to begin to flow into container E thereby causing the one-way valve S to close and preventing a further flow of water into or out of container E. This operation is necessary as container E would otherwise empty as soon as the level control device Z switches off the supply water into the evaporative cooler when sump A becomes full.

Whilst the evaporative cooler is operating, water evaporates into the air stream passing through the cooling pads thus causing the level control device Z to intermittently open the water supply solenoid C to maintain the full level in sump A. If container E is allowed to empty when the water supply solenoid C to the unit is switched off this will cause the drain valve J to open and allow the sump water to drain from sump A.

The drain in container E is required since if it were not fitted, once full, container E would remain full and it would not be possible to drain sump A when switching off the evaporative cooler.

When it is desired to drain sump A the inlet solenoid C is closed and the pump B is switched off. Water then drains out of pipe G and container E via pump B in a reverse direction due to gravity. Water is able to drain from container E as the one way valve S opens when pressure on it is removed due to water pump B no longer pumping water.

As the water drains from container E the downward force acting on connecting rod H is reduced as the total weight of container E decreases. When sufficient water has drained from the container E a point will be reached when the upward force exerted by spring I overcomes the downward forces acting upon it and container E will rise whilst rotating about the fulcrum W. As container E rises so will the outer valve sleeve K thereby opening valve J at seal N. Flexible couplings L are provided to allow for the up and downward rotational movement of container E as it fills and empties with water.

Lifting spring I must be designed so that the upward force exerted by it is sufficient to overcome the downward force generated by water container E when empty, the resistance to movement of flexible coupling L and the weight of all moving components of valve J. An additional upward force is required in order to ensure that valve J opens. The extent of this force should be designed to overcome any possibility of the valve jamming in the closed position and should also ensure that the valve opens at an acceptable rate when container E is drained.

Water from sump A can now drain away and the sump A remains empty until inlet solenoid C is switched on again.

The discharge point of the container E fill pipe is above the overflow point of water container E and is indicated by dimension V. This is designed to prevent water from being siphoned back into the main water supply system should it fail at any time. Height V should be sufficient to ensure that the system complies with regulations that may apply to sump filling systems in the countries or area of installation.

Figure 6:
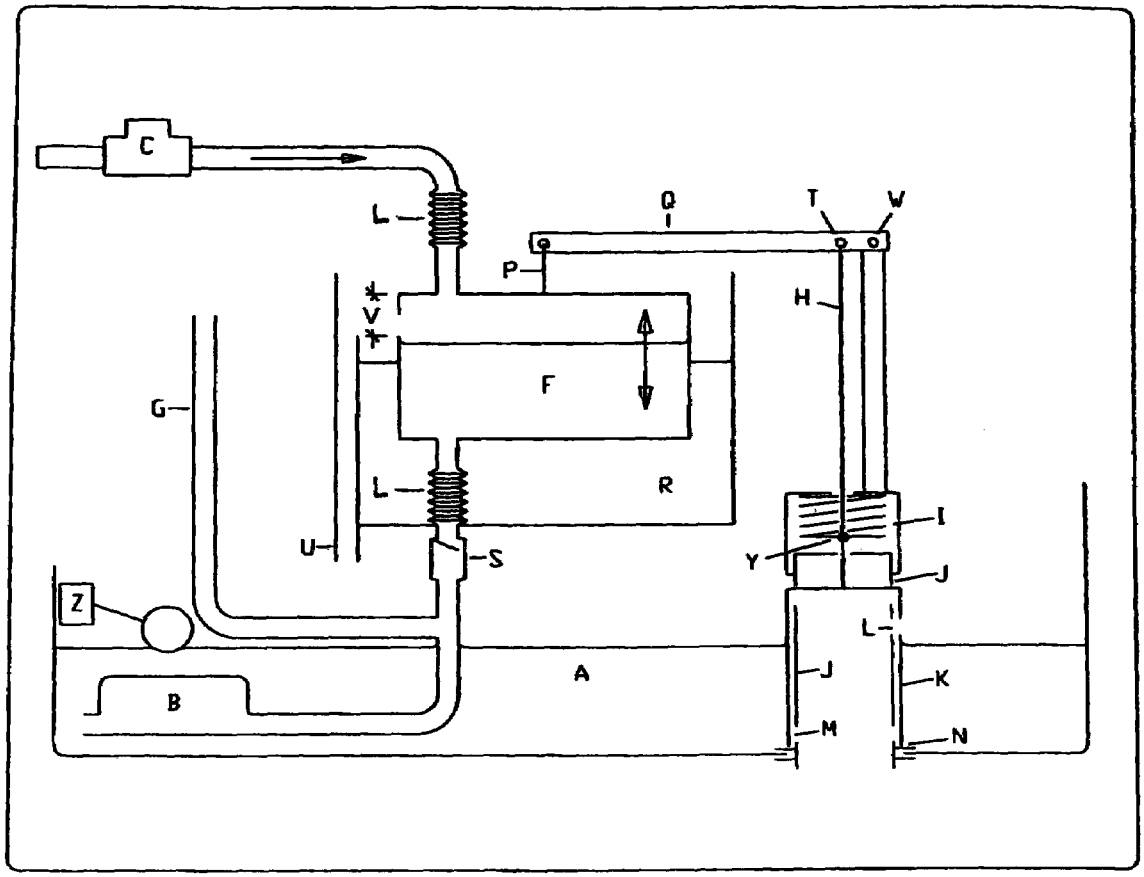

FIG. 6 also lacks the closure plate O shown in FIGS. 1 to 3. Drain valve J is initially in a closed position. When sump A is required to be filled with water, the level control device Z (or any other suitable level control device) will cause the water supply solenoid C to open and allow water to flow into the valve actuating float F. Float F remains at a lowest possible position whilst it is being filled. Float F begins to overflow into tank R as the filling process continues.

Valve J remains closed due to the force on the valve sleeve K of valve J via the connecting rod H. Actuator arm Q is connected to the connecting rod H at point T. Connecting rod H is forced downwards by the action of spring I and the downward force resulting from the weight of float F acting through the actuator arm Q. The force on the seal N is such that no leakage from the sump A occurs.

Tank R is filled and begins to overflow, with water entering sump A from the overflow pipe U.

Prior to switching on pump B and thereby bringing it into an operative condition, water from float F drains into the water sump A via the overflow in tank R and one way valve S and pump B. As mentioned in the description of FIG. 1, pump B is a centrifugal-type pump through which water is free to flow in the reverse direction when it is not running.

Float F remains full as the rate of flow of water out of the float is less than the inflow through its fill pipe. Water entering the main sump A from the overflow pipe U continues to fill the sump until sump A is full, at which point the level control device Z causes the water supply solenoid C to close.

A signal from the level control device Z may be used to start pump B. Pump B should be started at or soon after the time when the level control device Z causes the water supply solenoid C to close.

As soon as pump B is in an operative condition, water is pumped into pipe G which supplies water to the cooling pads of the evaporative cooler.

The pressure in pipe G causes water to begin to flow into float F which in turn causes the one way valve S to close, thereby preventing a further flow of water into or out of float F via the one way valve S. This is necessary as float F would otherwise begin to empty when the level control device Z switches off the supply water into the evaporative cooler when sump A becomes full.

Whilst the evaporative cooler is operating, water evaporates into the air stream passing through the cooling pads, thus causing the level control device Z to intermittently open the water supply solenoid C to maintain the full level in sump A.

The drain in float F is required since if it were not fitted, once full, it would remain full and it would not be possible to drain sump A when switching off the evaporative cooler.

If float F is allowed to empty when water supply solenoid C is switched off, this will cause the sump A to be drained in the manner described below.

When it is desired to drain sump A, the inlet solenoid C is closed and pump B is switched off. Water then drains from pipe G and float F, via pump B due to gravity. Water is able to drain from float F as the one way valve S opens when pressure on it is removed due to water pump B no longer pumping water.

As the water drains from float F it begins to float in the water contained in tank R and will transmit an upward force to connecting rod P which will cause an upward force to be transmitted to connecting rod H. When sufficient water has drained from float F, the actuator arm Q will rotate clockwise about the fulcrum W. The resultant upward force of connecting rod H will overcome the downward force of spring I which is holding the outer valve sleeve K of the valve J in the closed position. As valve sleeve K rises, the valve J is opened at seal N and water will be drained from sump A.

The upward force exerted by connecting rod H must be sufficiently large to overcome the downward force of spring I and other downward forces acting upon it. An additional upward force is required and should be incorporated into the design of the system to avoid the possibility of the valve J jamming in the closed position and to ensure that the valve J opens at an acceptable rate when float F is drained.

The discharge point of the water supply pipe into float F is above an overflow level as indicated by dimension V. This is designed to prevent water from being siphoned back into the main water supply system should it fail at any time. Height V should be sufficient to ensure that the system complies with regulations that may apply to sump filling systems in the countries or areas of installation.

It is to be appreciated that the invention is not limited to any specific embodiment as hereinbefore generally described or illustrated.

Referring to FIGS. 7 to 10, the embodiment is based on the principle of the apparatus described with reference to and shown in FIG. 5 and that description is referred to.

Figure 7:
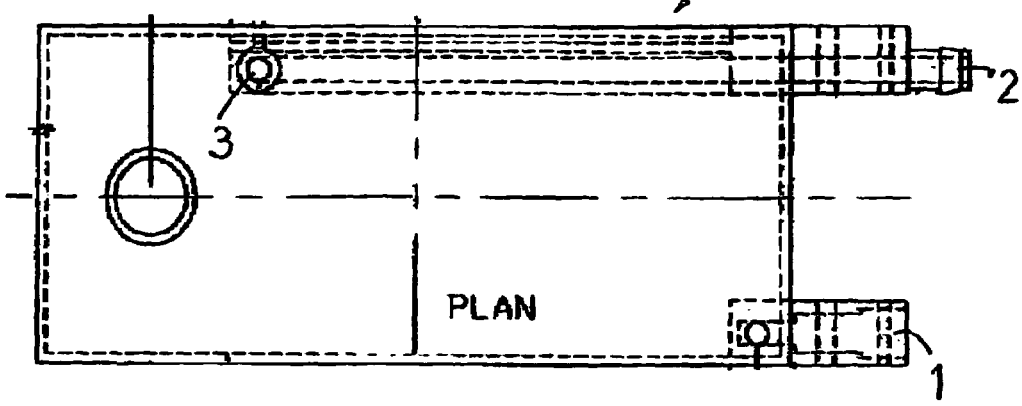
Figure 8:
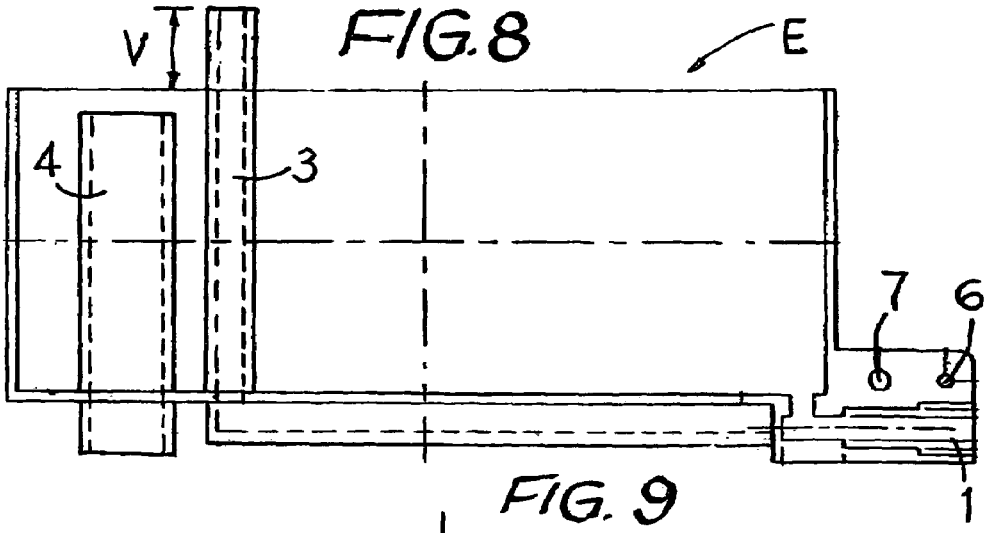

The one-way valve S can be incorporated into the main body of the water container at the position shown at 1 in FIGS. 7 and 8. This may be justified because the one-way valve S and the container E will generally never be subjected to anything harder (i.e. containing dissolved solids which are prone to scaling) or more impure than incoming supply water. As a result the valve S is unlikely to fail or block up and the insides of the valve and water tank E are unlikely to experience significant scale formation, even over a long period of time. The reason is that some of the initial water supplied to the system flows from the container E through the valve S and pump B into the sump A. This continues until the pump starts or the inlet solenoid C is closed. When the pump B starts the valve S closes immediately which prevents dirty, contaminated or dissolved solids concentrated water from reaching the valve.

Figure 9:
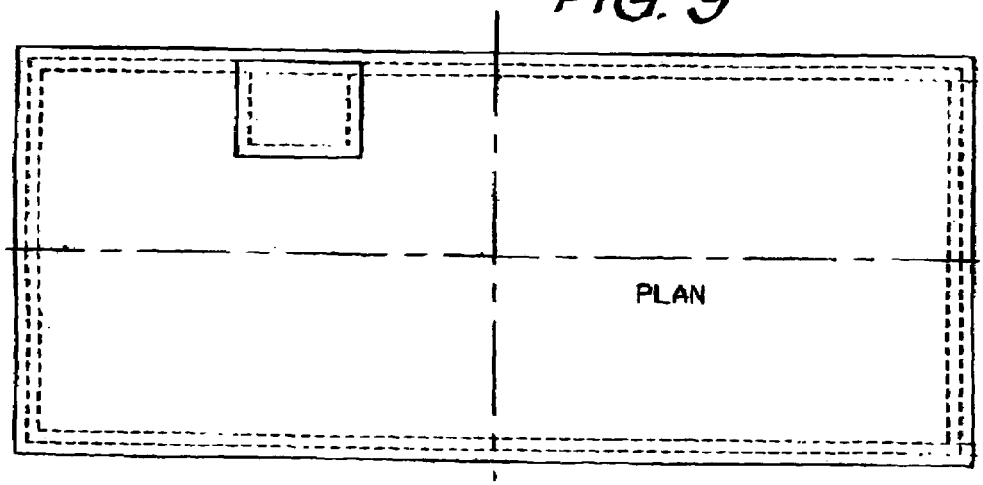
Figure 10:
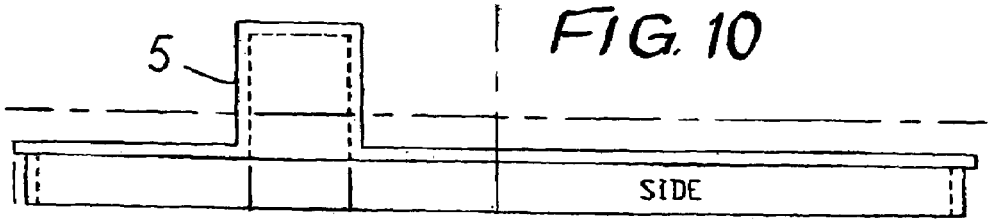

The water container E is shown, in FIG. 7 in plan view, FIG. 8 in side sectional elevation (section VIII—VIII shown in FIG. 7) and in FIGS. 9 and 10 the lid is shown in plan and side view, Inlet 1 receives water from the pump B, inlet 2 water from the control valve C, leading to pipe 3 which is the regulation height V above the top edge of the tank. Pipe 4 provides the sump pipe U. The raised dome 5 in the lid provides the effect of the separator X. The hole 6 provides for the fulcrum W and the hole 7 for connection of the connecting rod H.

REFERENCE LETTERS AND NUMERALS

A sump
B water pump
C solenoid
D level control device
E water container
F valve actuating float
G pipe
H connecting rod
I lifting spring
J drain valve
K valve sleeve
L flexible coupling
M drainage holes—sump to waste
N drain seal
O closure plate
P connecting rod—water container float to actuator arm Q
Q actuator arm
R water tank
S one-way valve
T connection point of H to Q
U sump fill pipe
V height to comply with regulations
W fulcrum
x separator
Y connection point—spring stop
Z level control device to control inlet solenoid

The invention claimed is:

1. An apparatus for periodically dumping liquids in an installation in which liquids accumulate dissolved and suspended contaminants, wherein the apparatus includes a container for a liquid, filling and draining means for the container to be alternately filled and drained during operation of the installation, resulting in one selected from changing buoyancy of the container, changing weight of the container and changing level of a float in the container, connecting means which connects the container to a dumping valve so as to actuate the dumping valve when one selected from a given critical buoyancy, weight and float level is passed, wherein said apparatus is applied to an evaporative cooling installation, in which water is circulated from a sump of the installation by connections from a pump to cooling means, characterized in that a water tank is included in circulation connections so as to be filled when the pump operates and to drain when the pump stops, the water tank being connected to a dumping valve, the dumping valve adapted to close when the tank is filled and to open it when the tank is not filled.

2. An apparatus according to claim 1, in which water is circulated from a sump of the installation by connections from a pump to cooling means, charaterized in that a spring is provided to bias the dumping valve to tend to open, the valve being closed when the container is filled or the float is lifted.

* * * * *